US011069299B2

(12) United States Patent
Kim

(10) Patent No.: US 11,069,299 B2
(45) Date of Patent: Jul. 20, 2021

(54) GATE DRIVER AND DISPLAY DEVICE INCLUDING THE SAME

(71) Applicant: Samsung Display Co., Ltd., Yongin-si (KR)

(72) Inventor: Chang-Yeop Kim, Cheonan-si (KR)

(73) Assignee: Samsung Display Co., Ltd.

( * ) Notice: Subject to any disclaimer, the term of this patent is extended or adjusted under 35 U.S.C. 154(b) by 207 days.

(21) Appl. No.: 15/380,964

(22) Filed: Dec. 15, 2016

(65) Prior Publication Data

US 2017/0186377 A1 Jun. 29, 2017

(30) Foreign Application Priority Data

Dec. 29, 2015 (KR) ..... 10-2015-0188349

(51) Int. Cl.
*G09G 3/3266* (2016.01)

(52) U.S. Cl.
CPC ..... *G09G 3/3266* (2013.01); *G09G 2310/08* (2013.01); *G09G 2320/0223* (2013.01)

(58) Field of Classification Search
CPC ..... G09G 3/3266; G09G 2310/08; G09G 2320/0223
See application file for complete search history.

(56) References Cited

U.S. PATENT DOCUMENTS 6,545,653 B1 * 4/2003 Takahara ..... G02F 1/1334 345/100
7,929,658 B2 * 4/2011 Lin ..... G11C 19/28 377/64
2008/0030445 A1 * 2/2008 Choi ..... G09G 3/3659 345/87
2008/0062112 A1 * 3/2008 Umezaki ..... G02F 1/136213 345/100
2009/0290677 A1 * 11/2009 Otose ..... G09G 3/3266 377/78
2010/0188385 A1 * 7/2010 Boiko ..... G09G 3/3677 345/211
2013/0249884 A1 * 9/2013 Kim ..... G09G 3/3677 345/212
2014/0146031 A1 * 5/2014 Lee ..... G11C 19/184 345/212
2016/0055818 A1 * 2/2016 Kim ..... G11C 19/287 345/210
2016/0187917 A1 * 6/2016 Lou ..... G09G 3/2096 345/213
2016/0372068 A1 * 12/2016 Yamamoto ..... G11C 19/28
2017/0140726 A1 * 5/2017 Zhu ..... G02F 1/136286
2017/0186377 A1 * 6/2017 Kim ..... G09G 3/3266
2017/0330526 A1 * 11/2017 Fan ..... G09G 3/3677
2018/0053471 A1 * 2/2018 Lin ..... G09G 3/3266

FOREIGN PATENT DOCUMENTS

KR 10-2009-0073711 A 7/2009
KR 10-2012-0031367 A 4/2012
WO WO-2014208123 A1 * 12/2014 ..... G11C 19/28

* cited by examiner

*Primary Examiner* — Alexander Eisen
*Assistant Examiner* — Nathaniel P Brittingham
(74) *Attorney, Agent, or Firm* — Innovation Counsel LLP

(57) ABSTRACT

A gate driver includes clock signal lines respectively transferring clock signals, at least two of the clock signals being mutually the same; and gate driving units electrically connected to the clock signal lines, respectively and configured to sequentially generate gate signals having a multi-clock pulse based on the clock signals.

12 Claims, 7 Drawing Sheets

GATE DRIVER AND DISPLAY DEVICE INCLUDING THE SAME

CROSS-REFERENCE TO RELATED APPLICATION(S)

This application claims priority under 35 USC § 119 to Korean Patent Application No. 10-2015-0188349, filed on Dec. 29, 2015 in the Korean Intellectual Property Office (KIPO), the contents of which are incorporated herein in its entirety by reference.

BACKGROUND

Technical Field

Example embodiments relate to a display device. More particularly, embodiments of the present inventive concept relate to an emission driver and a display device including the emission driver.

Description of the Related Art

An organic light emitting display device displays an image using an organic light emitting diode. A driving transistor which provides a driving current to the organic light emitting diode has hysteresis characteristics of a threshold voltage, and the threshold voltage is changed (or moved) according to a voltage applied to the driving transistor. For compensating the threshold voltage of the driving transistor accurately, the organic light emitting display device shifts (changes) the threshold voltage of the driving transistor in a certain direction in a hysteresis curve by applying a certain voltage based on a gate signal and compensates a shifted threshold voltage. Recently, a technique which repeatedly applies the certain voltage to improve accuracy of compensation of the threshold voltage is suggested, however, a load of the gate signal (e.g., a clock signal) for the certain voltage increase, and the gate signal is delayed by the load.

SUMMARY

Some example embodiments provide a gate driver to reduce a load of a gate signal and a delay of the gate signal.

Some example embodiments provide a display device including the gate driver.

According to example embodiments, a gate driver may include clock signal lines respectively transferring clock signals, at least two of the clock signals being mutually the same; and gate driving units electrically connected to the clock signal lines, respectively and configured to sequentially generate gate signals having a multi-clock pulse based on the clock signals.

In example embodiments, at least two of the gate driving units adjacent to each other may receive the same clock signal.

In example embodiments, the multi-clock pulse may include unit pulses for a driving period of the gate driver.

In example embodiments, a (6n+1)th gate driving unit among the gate driving units may generate a (6n+1)th gate signal based on a first clock signal having a logic low level in a first period and a logic high level in a second period, where n is a positive integer. A (6n+2)th gate driving unit adjacent to the (6n+1)th gate driving unit may generate a (6n+2)th gate signal based on a second clock signal having a logic high level in the first period and a logic low level in the second period, and a (6n+3)th gate driving unit adjacent to the (6n+2)th gate driving unit may generate a (6n+3)th gate signal based on a third clock signal having a logic low level in the first period and a logic high level in the second period, where the third clock signal is independent from the first clock signal.

In example embodiments, the first period may be a first half period of the first clock signal, and the second period may be a second half period of the first clock signal.

In example embodiments, a (6n+4)th gate driving unit adjacent to the (6n+3)th gate driving unit may generate a (6n+4)th gate signal based on a fourth clock signal having a logic high level in the first period and a logic low level in the second period, where the fourth clock signal is independent from the second clock signal. A (6n+5)th gate driving unit adjacent to the (6n+4)th gate driving unit may generate a (6n+5)th gate signal based on a fifth clock signal having a logic low level in the first period and a logic high level in the second period, where the fifth clock signal is independent from the first clock signal. A (6n+6)th gate driving unit adjacent to the (6n+5)th gate driving unit may generate a (6n+6)th gate signal based on a sixth clock signal having a logic high level in the first period and a logic low level in the second period, where the sixth clock signal is independent from the second clock signal.

In example embodiments, the first gate driving unit may generates a second start signal having the multi-clock pulse based on a start signal having a logic low level and the second clock signal and may output the first clock signal having a logic low level as the (6n+1)th gate signal based on the second start signal.

In example embodiments, the (6n+2)th gate driving unit may output the second clock signal having a logic low level as the (6n+2)th gate signal based on the (6n+1)th gate signal having a logic low level and the first clock signal.

In example embodiments, the (6n+4)th gate driving unit may output the fourth clock signal having a logic low level as the (6n+4)th gate signal based on the (6n+3)th gate signal having a logic low level and the third clock signal.

In example embodiments, the (6n+5)th gate driving unit may output the fifth clock signal having a logic low level as the (6n+5)th gate signal based on the (6n+4)th gate signal having a logic low level and the fifth clock signal.

In example embodiments, the third clock signal may have a period which is the same as a period, a waveform and a phase which are the same as a period, a waveform and a phase of the first clock signal.

In example embodiments, the third clock signal may have a period and a waveform which are the same as a period and a waveform of the first clock signal, and a phase which is delayed with respect to a phase of the first clock signal.

In example embodiments, the clock signal lines may include a first clock signal line transferring the first clock signal, a second clock signal line transferring the second clock signal, and a third clock signal line transferring the third clock signal.

In example embodiments, a (4n+1)th gate driving unit among the gate driving units may generate a (4n+1)th gate signal based on a first clock signal having a logic low level in a first period and a logic high level in a second period, where n is a positive integer. A (4n+2)th gate driving unit adjacent to the (4n+1)th gate driving unit may generate a (4n+2)th gate signal based on a second clock signal having a logic high level in the first period and a logic low level in the second period. A (4n+3)th gate driving unit adjacent to the (4n+2)th gate driving unit may generate a (4n+3)th gate signal based on a third clock signal having a logic low level in the first period and a logic high level in the second period, where the third clock signal is independent from the first clock signal.

According to example embodiments, a display device may include a display panel; clock signal generator configured to generate clock signals, at least two of the clock signals being mutually the same; and a gate driver configured to sequentially provide the display panel with gate signals having a multi-clock pulse. Here, the gate driver may include clock signal lines respectively transferring the clock signals, and gate driving units electrically connected to the clock signal lines, respectively and configured to sequentially generate the gate signals based on the clock signals.

In example embodiments, at least two of the gate driving units adjacent to each other may receive the same clock signal.

In example embodiments, the clock signal generator generates: a first clock signal having a logic low level in a first period and a logic high level in a second period, a second clock signal having the logic high level in the first period and the logic low level in the second period, a third clock signal having the logic low level in the first period and the logic high level in the second period, and a fourth clock signal having the logic high level in the first period and the logic low level in the second period. Here, the third clock signal may be independent from the first clock signal, and the fourth clock signal may be independent from the second clock signal.

In example embodiments, the clock signal lines may include a first clock signal line transferring the first clock signal, a second clock signal line transferring the second clock signal, a third clock signal line transferring the third clock signal, and a fourth clock signal line transferring the fourth clock signal.

In example embodiments, a (4n+1)th gate driving unit among the gate driving units may be electrically connected to the first clock signal line and the second clock signal line, a (4n+2)th gate driving unit adjacent to the (4n+1)th gate driving unit may be electrically connected to the first clock signal line and the second clock signal line, and a (4n+3)th gate driving unit adjacent to the (4n+2)th gate driving unit may be electrically connected to the third clock signal line and the fourth clock signal line, where n is a positive integer.

In example embodiments, a (4n+1)th gate driving unit among the gate driving units may be electrically connected to the first clock signal line and the second clock signal line, a (4n+2)th gate driving unit adjacent to the (4n+1)th gate driving unit may be electrically connected to the second clock signal line and the third clock signal line, and a (4n+3)th gate driving unit adjacent to the (4n+2)th gate driving unit may be electrically connected to the third clock signal line and the fourth clock signal line.

Therefore, a gate driver according to example embodiments may reduce loads of gate signals and delays of the gate signals by generating the gate signals (e.g., gate signals provided to adjacent pixel rows) based on clock signals which are the same but mutually independent.

A display device according to example embodiments may prevent degradation of display quality (e.g., quality of displayed image) due to delays of gate signals.

BRIEF DESCRIPTION OF THE DRAWINGS

Illustrative, non-limiting example embodiments will be more clearly understood from the following detailed description taken in conjunction with the accompanying drawings.

DESCRIPTION OF EMBODIMENTS

Hereinafter, the present inventive concept will be explained in detail with reference to the accompanying drawings.

Figure 1:
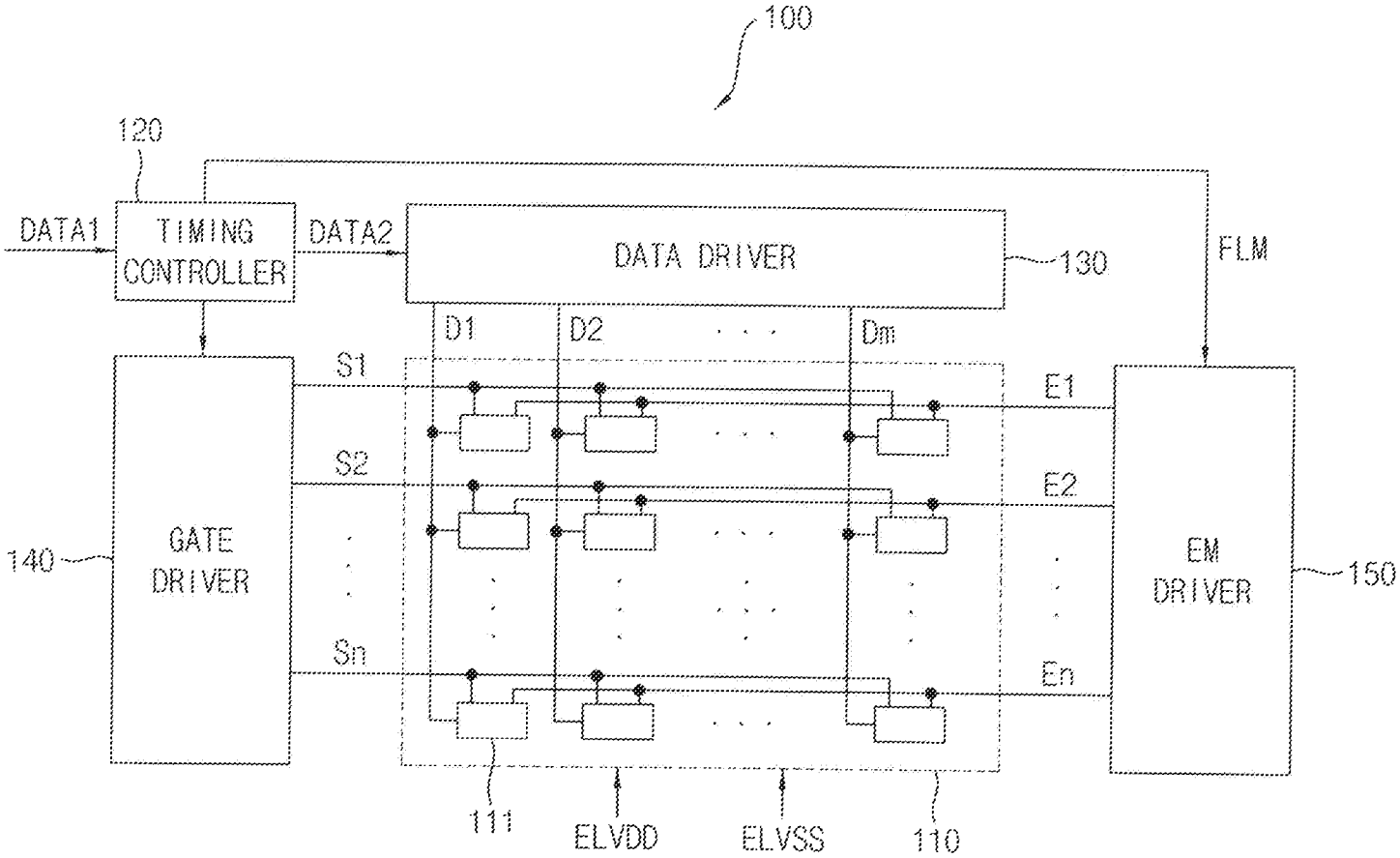
FIG. 1 is a block diagram illustrating a display device according to example embodiments.

FIG. 1 is a block diagram illustrating a display device according to example embodiments.

Referring to FIG. 1, the display device 100 may include a display panel 110, a timing controller 120, a data driver 130, a gate driver 140, and an emission driver 150 (or a light emission driver, EM driver). The display device 100 may display an image based on image data DATA1 provided from an external device, for example, a graphic controller. For example, the display device 100 may be an organic light emitting display device.

The display panel 110 may include gate lines S1 through Sn, data lines D1 through Dm, light emission control lines E1 through En, and pixels 111, where each of m and n is an integer greater than or equal to 2. The pixels 111 may be located in cross-regions of the gate lines S1 through Sn, the data lines D1 through Dm, and light emission control lines E1 through En.

Each of the pixels 111 may store a data signal (e.g., a data signal provided through the data lines D1 through Dm) in response to a gate signal (e.g., a gate signal provided through the gate lines S1 through Sn) (or a scan signal) and may emit light based on a stored data signal and a light emission control signal (e.g., a light emission control signal provided through the light emission control line E1 through En). In addition, the pixels 111 may compensate a threshold voltage of a driving transistor which is included in each of the pixels by applying an initialization voltage to the driving transistor in response to the gate signal. Thus, the pixels 111 may exclude an effect (or influence) of the threshold voltage shift on the data signal.

The data driver 130 may generate the data signal based on second data DATA2. The data driver 130 may provide the data signal to the display panel 110 in response to a data driving control signal.

The gate driver 140 may generate the gate signal based on the gate driving control signal. The gate driving control signal may include a start pulse and clock signals, and the gate driver 140 may include gate driving units (or shift registers) sequentially generating the gate signal corresponding to the start pulse and the clock signals.

In some example embodiments, at least two of clock signals may be the same. That is, at least one of the clock signals may be substantially the same as or similar to another of the clock signals. For example, the clock signals may include a first clock signal and a third clock signal. The third clock signal may have a period the same as a period of the first clock signal and a waveform the same as a waveform of the first clock signal. However, a phase of the third clock signal may be different from a phase of the first clock signal, for example, the phase of the third clock signal may be delayed with respect to a phase of the first clock signal. For example, a difference of phases of the first and third clock signals may be greater than 0. The clock signals will be described in detail with reference to the FIGS. 3 and 6.

In some example embodiments, the gate signal may have multi-clock pulse. Here, the multi-clock pulse may include pulses for a driving period (or a time period for sensing/compensating a threshold voltage) of the gate driver 140. The gate signal will be described with reference to FIG. 5.

In some example embodiments, at least two of the gate driving units (or sub gate drivers) adjacent to each other may receive clock signals which are the same but independent from each other. For example, a first gate driving unit may receive a first clock signal and a second clock signal, and a second gate driving unit which is adjacent to the first gate driving unit may receive the first clock signal and a second clock signal. In addition, a third gate driving unit which is adjacent to the second gate driving unit may receive the third clock signal and a fourth clock signal. Here, the first clock signal and the third clock signal may be the same, and the second clock signal and the fourth clock signal may be the same. In addition, the second clock signal and the fourth clock signal may be inverted signals of the first clock signal and the third clock signal, respectively.

The gate driving units may output the gate signals based on the clock signals, respectively. At least two of the gate driving units (e.g., gate driving units adjacent to each other) may sequentially output gate signals which are independent from each other with regard to loads (or power) because the at least two of the gate driving units respectively receive clock signals which are independent from each other (or different clock signals). Therefore, the display device 100 may reduce (or distribute) loads of the gate signals (or the clock signals) and may prevent a delay of the gate signals according to reduction of the load of the gate signals. In addition, the display device 100 may prevent degradation of a display quality (or a quality of a displayed image).

A configuration of the gate driver 140 and a configuration of a date driving unit will be described in detail with reference to FIGS. 2 and 4.

The emission driver 150 may generate a light emission control signal based on a light emission driving control signal and may provide the light emission control signal to the pixels 111 through the light emission control lines E1 through En. The emission driver 150 may determine a light emission time or a light non-emission time (or, an off-duty) of the pixels 111 based on the light emission driving control signal. The pixels 111 may emit lights in response to the light emission control signal having a logic low level (or, a low voltage, a low voltage level, a turn-off level).

The timing controller 120 may control the data driver 130, the gate driver 140, and the emission driver 150. The timing controller 120 may provide the clock signals and the start pulse to the gate driver 140. The timing controller 120 may generate the data driving control signal and may provide the data driver 130 with the data driving control signal and the second data DATA2 generated by processing the input data DATA'. The timing controller 120 may generate and provide the light emission driving control signal to the emission driver 150.

In some example embodiments, the timing controller 140 (or display device 100) may include a clock signal generator which generates the clock signals.

The display device 100 may include a power supply. The power supply may generate driving voltages required to driving the display device 100. The driving voltages may include a first power voltage ELVDD and a second power voltage ELVSS. Here, the first power voltage ELVDD may be greater than the second power voltage ELVSS.

As described above, the display device 100 may generate the gate signals (e.g., gate signals provided to pixel rows which is adjacent to each other) based on the clock signals which are the same as each other but mutually independent from each other. Here, the gate signals may be provided to respective gate driving units through different clock signal lines, therefore, the display device 100 may reduce loads and a delay of each of the gate signals. In addition, the display device 100 may prevent degradation of the display quality due to the delay of the gate signals.

Figure 2:
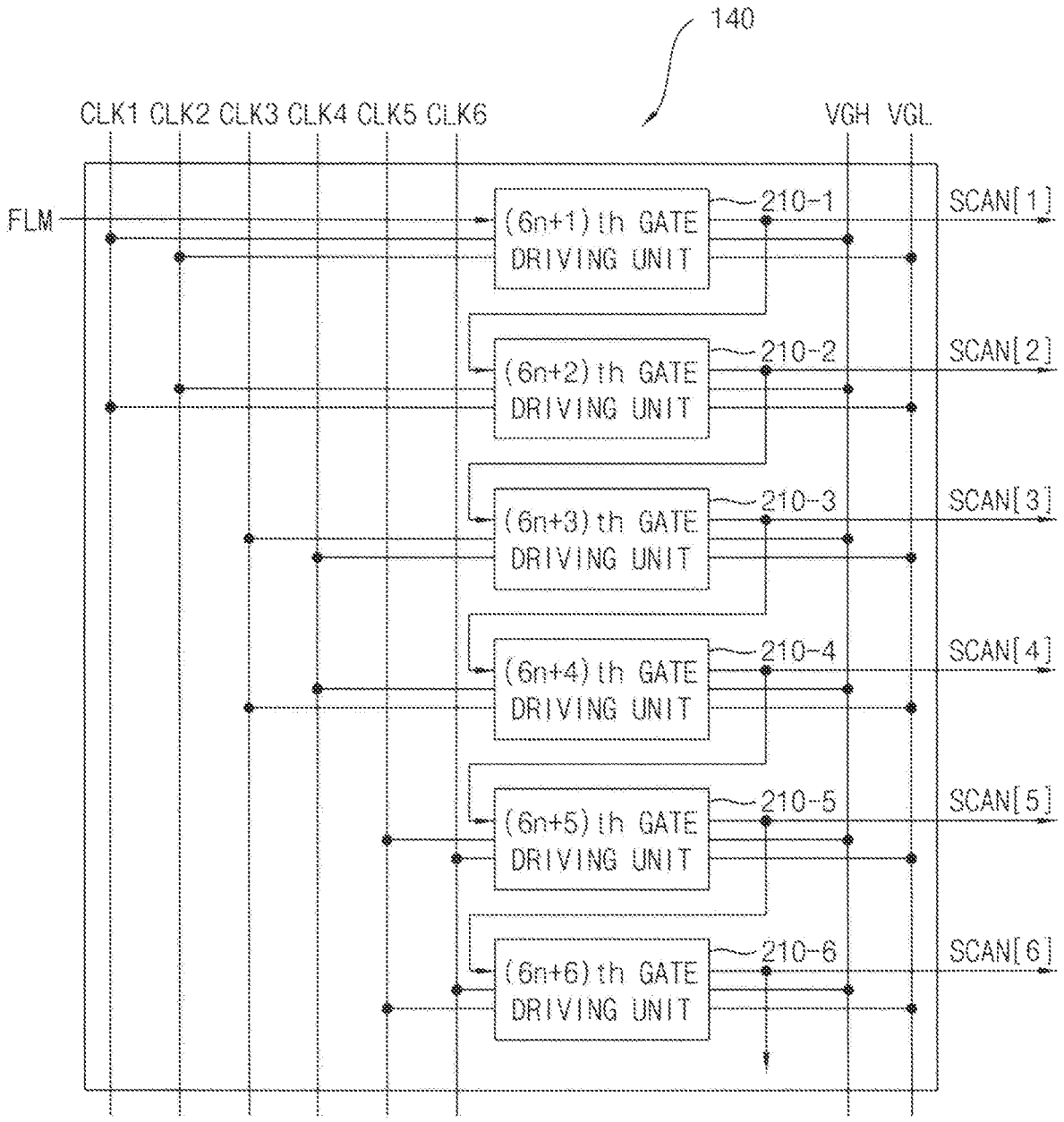
FIG. 2 is a diagram illustrating an example of a gate driver included in the display device of FIG. 1.
Figure 3:
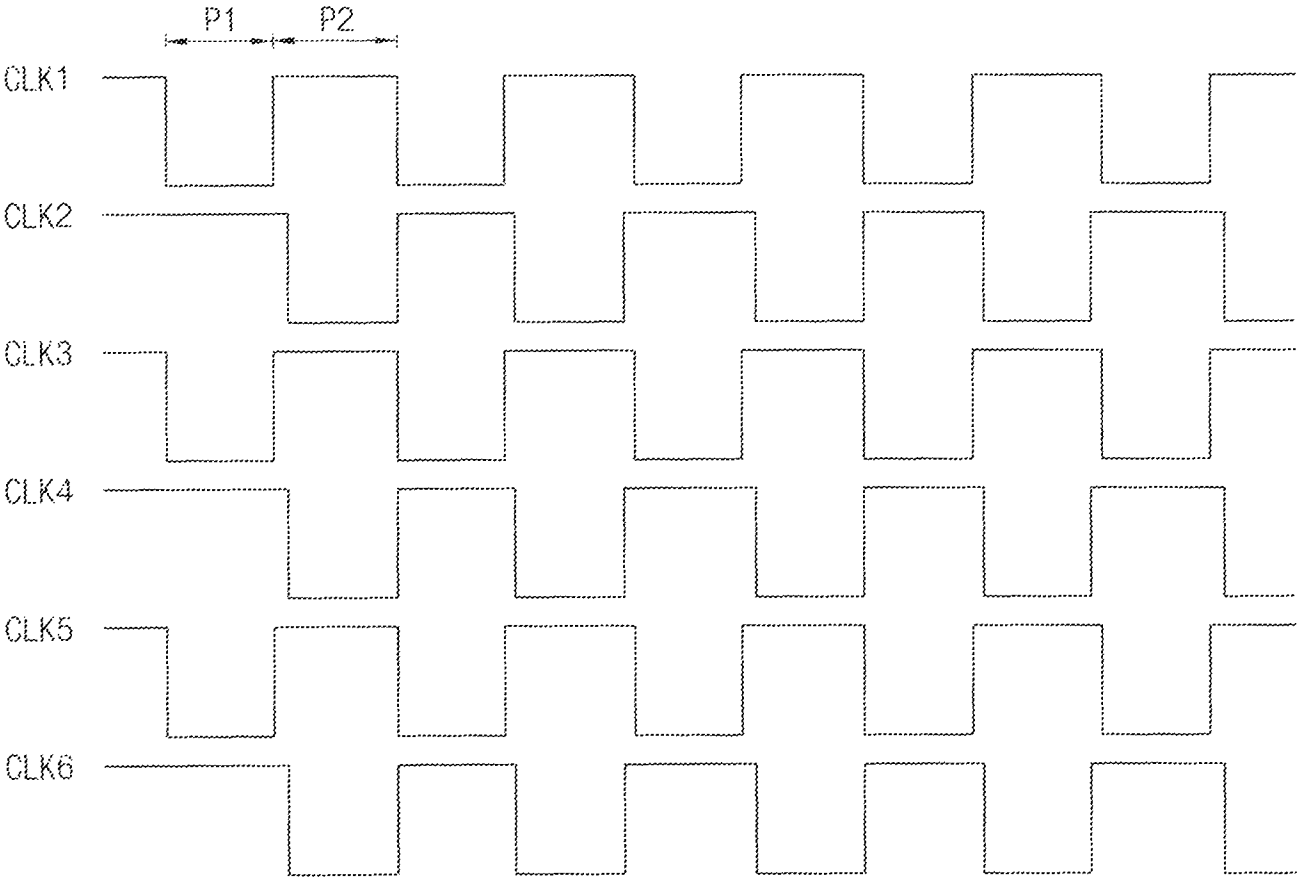
FIG. 3 is a waveform diagram illustrating an example of clock signals provided to the gate driver of FIG. 2.

FIG. 2 is a diagram illustrating an example of a gate driver included in the display device of FIG. 1. FIG. 3 is a waveform diagram illustrating an example of clock signals provided to the gate driver of FIG. 2.

Referring to FIGS. 2 and 3, the gate driver 140 may include clock signal lines and gate driving units 210-1 through 210-6 (or sub gate drivers).

The clock signal lines may transfer clock signals CLK1 through CLK6, respectively. For example, the gate driver 140 may include six clock signal lines through which six clock signals CLK1 through CLK6 may be transferred, respectively.

As described above, at least two of the clock signals CLK1 through CLK6 may be the same. As illustrated in FIG. 3, the first clock signal CLK1, the third clock signal CLK3, and the fifth clock signal CLK5 may be the same. In addition, the second clock signal CLK2, the fourth clock signal CLK4, and the sixth clock signal CLK6 may be the same.

The first clock signal CLK1 may have a logic low level (or a low voltage, a low voltage level, a turn-on voltage) in a first period P1 and may have a logic high level (or a high voltage, a high voltage level, a turn-off voltage) in a second period P2. Here, the first period P1 may be a first half period (or a former half period) of the first clock signal CLK1, and the second period P2 may be a second half period (or an after half period) of the first clock signal CLK1. The first clock signal CLK1 may have the logic low level in a time which is the same as or shorter than the first period P1. In addition, the first clock signal CLK1 may have the logic high level in a time which is the same as or shorter than the second period P2. That is, the first clock signal CLK1 may be a square wave, and on-duty (or a duty cycle) of the first clock signal CLK1 may be equal to or less than 50 percentages (%).

The second clock signal CLK2 may have the logic high level in the first period P1 and may have the logic low level in the second period P2. For example, the second clock signal CLK2 may be an inverted signal of the first clock signal CLK1. For example, the second clock signal CLK2 may have a period and a waveform which are the same as a period and a waveform of the first clock signal CLK1 but has a certain phase difference with respect to the first clock signal CLK1. Here, the certain phase difference may be a half of the period of the first clock signal CLK1.

The third clock signal CLK3 and the fifth clock signal CLK5 may be the same as or substantially the same as the first clock signal CLK1. The fourth clock signal CLK4 and the sixth clock signal CLK6 may be the same as or substantially the same as the second clock signal CLK2. Therefore, duplicated description will not be repeated.

In some example embodiments, the third clock signal CLK3 may have a period, a waveform and a phase which are the same as a period, a wave form and a phase of the first clock signal CLK1.

In some example embodiments, the third clock signal CLK3 may have a period and a waveform which are the same as a period of the first clock signal CLK1 but have a phase which is different from (or delayed with respect to) a phase of the first clock signal CLK1.

Referring again to FIG. 2, the clock signal lines may extend in a first direction substantially perpendicular to the gate lines S1 through Sn illustrated in FIG. 1 (or parallel to the data lines D1 through Dm) and may be arranged along a second direction substantially parallel to the gate lines S1 through Sn.

The gate driving units 210-1 through 210-6 may be electrically connected to the clock signal lines, respectively, and may sequentially generate the gate signals based on the clock signals. Here, the gate signals may have multi-clock pulses.

As illustrated in FIG. 2, the first gate driving unit 210-1 (or a (6n+1)th gate driving unit) may be electrically connected to the first clock signal line (e.g., a clock signal line transferring the first clock signal CLK1) and the second clock signal line (e.g., a clock signal line transferring the second clock signal CLK2), may receive a high voltage VGH (or first voltage), a low voltage VGL (or a second voltage), and a start signal FLM, and may output a first gate signal SCAN[1] based on the first clock signal CLK1, the second clock signal CLK2, and the start signal FLM. Here, the high voltage VGH and the low voltage VGL may be voltages for driving the gate driving units, the high voltage VGH may have a voltage level equal to a logic high level, and the low voltage VGL may have a voltage level equal to a logic low level. In addition, the first gate driving unit 210-1 may provide the first gate signal SCAN[1] (as a carry signal) to the second gate driving unit 210-2.

The second gate driving unit 210-2 (or a (6n+2)th gate driving unit) may be electrically connected to the first clock signal line and the second clock signal line, may receive the high voltage VGH, the low voltage VGL, and the first gate signal SCAN[1], and may output a second gate signal SCAN[2] based on the first clock signal CLK1, the second clock signal CLK2, and the first gate signal SCAN[1].

The third gate driving unit 210-3 (or a (6n+3)th gate driving unit) may be electrically connected to the third clock signal line (e.g., a clock signal line transferring the third clock signal CLK3) and the fourth clock signal line (e.g., a clock signal line transferring the fourth clock signal CLK4), may receive the high voltage VGH, the low voltage VGL, and the second gate signal SCAN[2], and may output a third gate signal SCAN[3] based on the third clock signal CLK3, the fourth clock signal CLK4, and the second gate signal SCAN[2].

The fourth gate driving unit 210-4 (or a (6n+4)th gate driving unit) may be substantially the same as the third gate driving unit 210-3, may receive the third gate signal SCAN [3], and may output a fourth gate signal SCAN[4].

The fifth gate driving unit 210-5 (or a (6n+5)th gate driving unit) may be electrically connected to the fifth clock signal line (e.g., a clock signal line transferring the fifth clock signal CLK5) and the sixth clock signal line (e.g., a clock signal line transferring the sixth clock signal CLK6), may receive the high voltage VGH, the low voltage VGL, and the fourth gate signal SCAN[4], and may output a third gate signal SCAN[5] based on the fifth clock signal CLK5, the sixth clock signal CLK6, and the fourth gate signal SCAN[4].

The sixth gate driving unit 210-6 (or a (6n+6)th gate driving unit) may be substantially the same as the fifth gate driving unit 210-5, may receive the fifth gate signal SCAN [5], and may output a sixth gate signal SCAN[6].

As described above, odd-numbered gate driving units 210-1, 210-3, and 210-5 may receive the same gate clock signals, the first through sixth clock signals CLK1 through CLK6, through different clock signal lines. In addition, even-numbered gate driving units 210-2, 210-4, and 210-6 may receive the same gate signals, the first through sixth clock signals CLK1 through CLK6, through different clock signal lines.

Six clock signals CLK1 through CLK6 are illustrated in FIG. 2, however, the clock signals is not limited thereto. The number of clock signals may be altered so long as at least two clock signals is same. For example, clock signals of two, three, fourth, five, seven or a number grater than seven may be generated. It is illustrated in FIG. 2 that two of the gate driving units 210-1 through 210-6 (e.g., the first and second driving units 210-1 and 210-2) constitute a pair and are electrically connected to the same clock signal lines. However, the gate driving units are not limited thereto. For example, the second gate driving unit 210-2 may be electrically connected to the second clock signal line and the third clock signal line.

Figure 4:
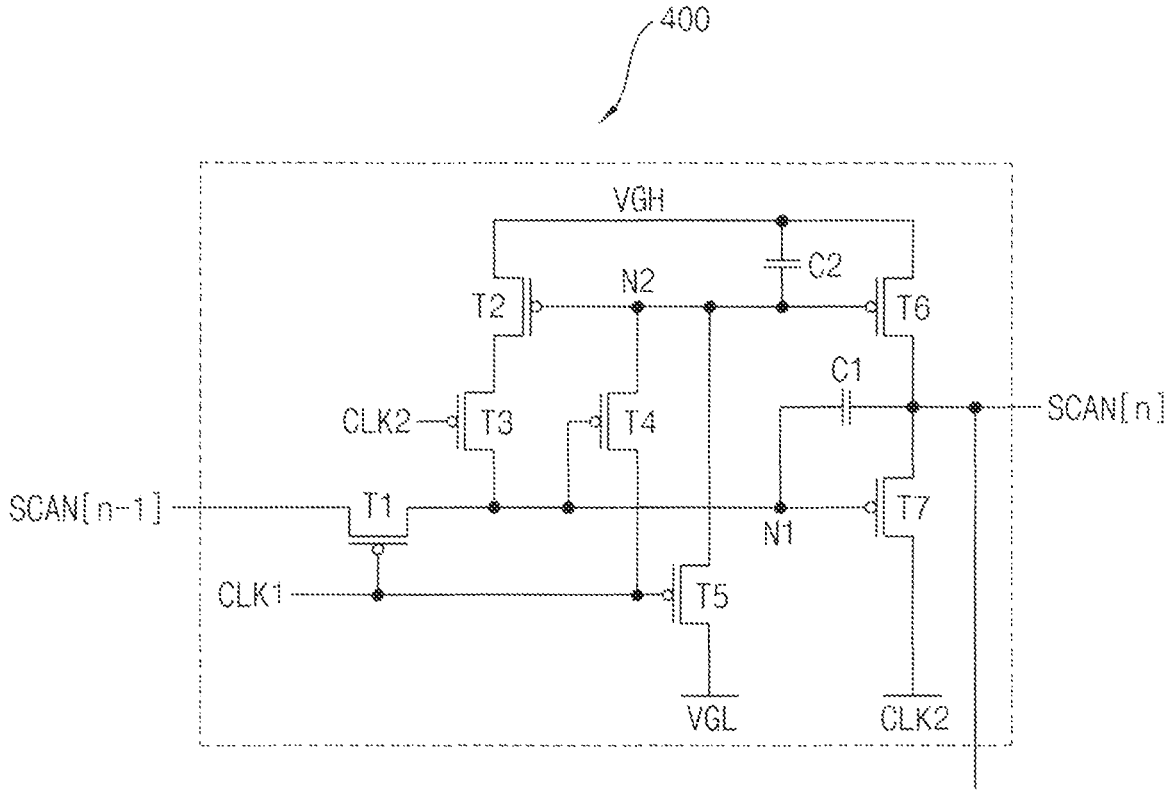
FIG. 4 is a circuit diagram illustrating an example of a gate driving unit included in the gate driver of FIG. 2.
Figure 5:
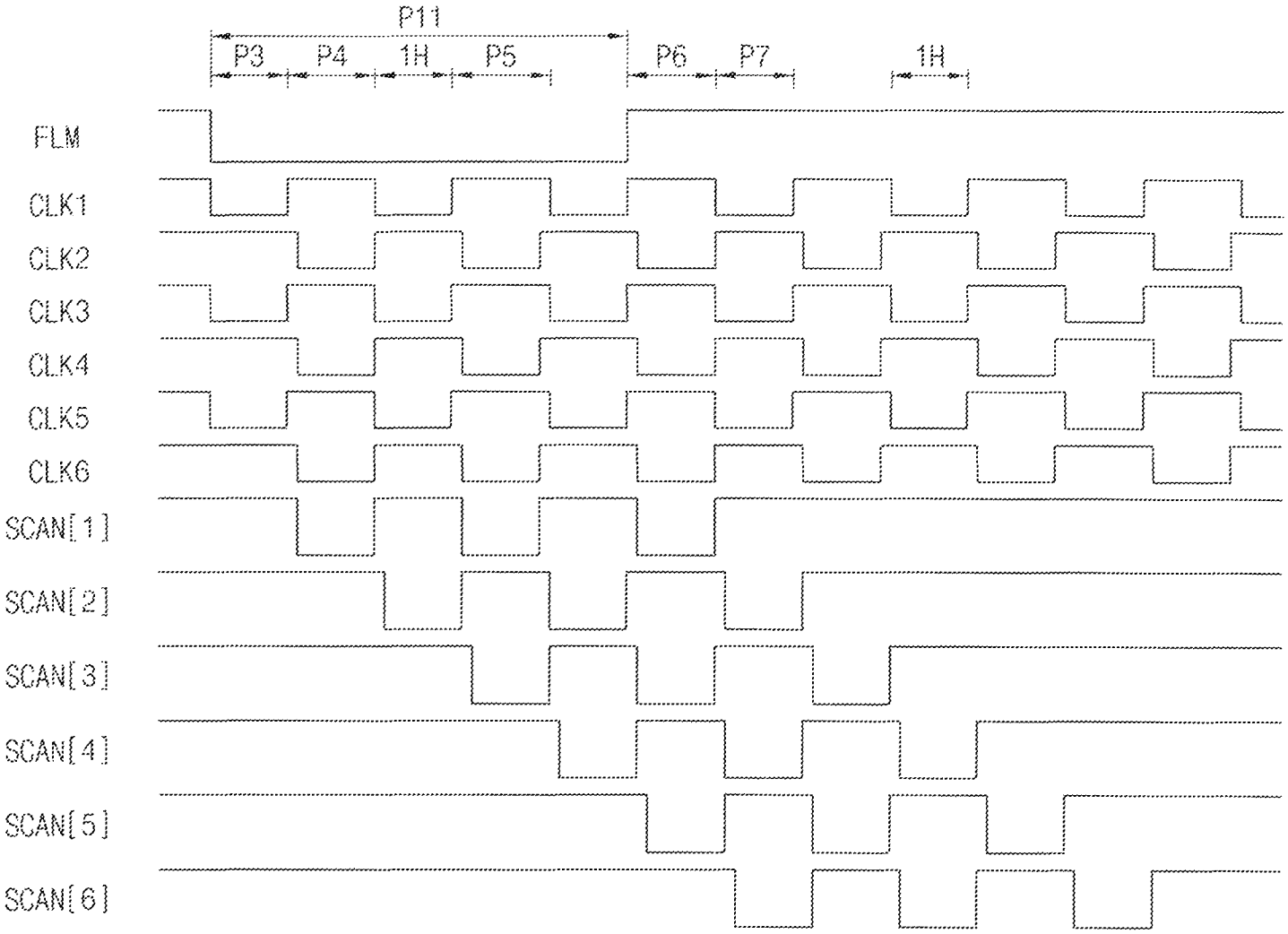
FIG. 5 is a diagram illustrating an example of gate signals generated by the gate driver of FIG. 2.

FIG. 4 is a circuit diagram illustrating an example of a gate driving unit included in the gate driver of FIG. 2. FIG. 5 is a diagram illustrating an example of gate signals generated by the gate driver of FIG. 2.

Referring to FIG. 4, a gate driving unit 400 (e.g., one of the gate driving units 210-1 through 210-6) may output an nth gate signal SCAN[n] in response to an (n−1)th gate signal SCAN[n−1], the first cock signal CLK1, the third clock signal CLK3 or the fifth clock signal CLK5, and the second clock signal CLK2, the fourth clock signal CLK4 or the sixth clock signal CLK6.

The gate driving unit 400 may include first through seventh transistors T1 through T7, a first capacitor C1, and a second capacitor C2.

The first transistor T1 may transfer the (n−1)th gate signal SCAN[n−1] to a first node N1 in response to the first clock signal CLK1. The first capacitor C1 may store the (n−1)th gate signal SCAN[n−1] (or a voltage applied to the first node N1). The seventh transistor T7 may pull down the nth gate signal SCAN[n] to have a voltage equal to a voltage of the second clock signal CLK2 based on a first node voltage at the first node N1.

As illustrated in FIG. 5, in a third period P3, the start signal FLM (or, a first start signal) may have a logic low level, and the first clock signal CLK1 may have a logic low level. Here, in the first gate driving unit 210-1, the first transistor T1 may be turned on based on the logic low level of the first clock signal CLK1 and may transfer the start signal FLM having the logic low level to the first node N1. The first capacitor C1 may store the start signal FLM. The seventh transistor T7 may be turned on in response to the first node voltage at the first node N1 (e.g., the logic low level). The first gate signal SCAN[1] may have the logic high level because the second clock signal CLK2 has the logic high level.

In the fourth period P4, the second clock signal CLK2 may have the logic low level. Here, the seventh transistor T7 may maintain to be turned on in response to the first node voltage at the first node N1 (e.g., the logic low level) and may full down the first gate signal SCAN[1] to have the logic low level (e.g., to be equal to the second clock signal CLK2 having the logic low level). Therefore, the first gate driving unit 210-1 may output the first gate signal SCAN[1] having the logic low level in the fourth period P4.

Similarly, the second gate driving unit 210-2 may output a second gate signal SCAN[2] having the logic low level based on the first gate signal SCAN[1] in a fifth period P5. The third through sixth gate driving units 210-3 through 210-6 may sequentially output the third through sixth gate signals SCAN[3] through SCAN[6] having the logic low level.

Referring again to FIG. 4, the fourth transistor T4 may transfer the first clock signal CLK1 to a second node N2 in response to the first node voltage at the first node N1. The fifth transistor T5 may transfer the low voltage VGL to the second node in response to the first clock signal CLK1. The second capacitor C2 may store a voltage applied to the second node N2. The sixth transistor T6 may be turned on/off in response to a second node voltage at the second node N2 (or a voltage stored in the second capacitor C2).

The second transistor T2 may be turned on in response to the second node voltage at the second node N2 and may transfer the high voltage VGH to the third transistor T3. The third transistor T3 may be turned on in response to the second clock signal CLK2 and may transfer the high voltage VGH to the first node N1.

In the third period P3 as illustrated in FIG. 5, the fourth transistor T4 in the first gate driving unit 210-1 may be turned on in response to the start signal FLM having the logic low level, and the fifth transistor T5 may be turned on in response to the first clock signal CLK1 having the logic low level. Therefore, the low voltage VGL (or the first clock signal CLK1 having the logic low level) may be transferred to the second node N2. The second capacitor C2 may store the low voltage VGL, and the sixth transistor T6 may be turned on and may output the first gate signal SCAN[1] equal to the high voltage VGH. Therefore, in the third period P3, the first gate driving unit 210-1 may output the first gate signal SCAN[1] having the high voltage VGH (or the logic high level).

The gate driving unit 400 may output the nth gate signal SCAN[n] having a multi-clock pulse according to a waveform of the (n−1)th gate signal SCAN[n].

As illustrated in FIG. 5, the start signal FLM may have the logic low level during an eleventh period P11 (e.g., during five horizontal time 5H). Here, the first gate driving unit 210-1 may output the first gate signal SCAN[1] having the logic low level in the fourth period, in the fifth period, and in the sixth period P5. Similarly, the second through sixth gate driving units 210-2 through 210-6 may sequentially output the second through sixth gate signal SCAN[2] through SCAN[6] which are sequentially shifted by one horizontal time with respected to the first gate signal SCAN [1].

Here, a driving transistor (e.g., a driving transistor respectively included in the pixels 111) illustrated in FIG. 1 (e.g., pixels electrically connected to the first through sixth gate driving units 210-1 through 210-6) may be repeatedly applied with an initialization voltage (or a bias voltage) in response to the first through sixth gate signals SCAN[1] through SCAN[6] having a multi-clock pulse. Therefore, a threshold voltage of the driving transistor may be shifted (or moved) in a certain direction (e.g., to a certain point having a value of hysteresis curve of the threshold voltage of the driving transistor), and the display device 100 may compensate the threshold voltage of the driving transistor.

In a conventional gate driver, the first through sixth gate driving units 210-1 through 210-6 generates the first through sixth gate signals SCAN[1] through SCAN[6] based on only the first and second clock signals CLK1 and CLK2. Here, loads of the first and second clock signals CLK1 and CLK2 increases. For example, in the sixth period P6, the first gate signal SCAN[1], the third gate signal SCAN[3], and the fifth gate signal SCAN[5] have the logic low level based on the second clock signal CLK2. Here, a load of the second clock signal CLK2 may increase three times with respect to a load of the second clock signal CLK2 in the fourth period P4. Similarly, in a seventh period P7, a load of the first clock signal CLK1 may increase, The display device 100 according to example embodiments may generate the gate signals, which are adjacent to each other, based on the clock signals which are the same as each other but mutually independent from each other. Therefore, the display device 100 may reduce loads of the clock signals.

For example with reference to FIGS. 2, 4, and 5, in the sixth period P6, the first gate signal SCAN[1] may be generated based on the second clock signal CLK2, the third gate signal SCAN[3] may be generated based on the fourth clock signal CLK4, and the fifth gate signal SCAN[5] may be generated based on the sixth clock signal CLK6. In addition, in the seventh period P7, the second gate signal SCAN[2] may be generated based on the first clock signal CLK1, the fourth gate signal SCAN[4] may be generated based on the third clock signal CLK3, and the sixth gate signal SCAN[6] may be generated based on the fifth clock signal CLK5. That is, the first through sixth clock signals is used to generate one gate signal (e.g., one of the first through sixth gate signals SCAN[1] through SCAN[6]) such that the loads of the first through sixth clock signals CLK1 through CLK6 may be reduced.

It is illustrated in FIG. 4 that the gate driving unit 400 outputs the second clock signal CLK2 as the (n)th gate signal SCAN[n] based on the first clock signal CLK1. However, the gate driving unit 400 is not limited thereto. For example, the gate driving unit 400 may output the first clock signal CLK1 (or the first clock signal CLK3, the fifth clock signal CLK5) as the nth gate signal SCAN[n] based on the second clock signal CLK2 (or the fourth clock signal CLK4, the sixth clock signal CLK6).

It is illustrated in FIG. 4 that the start signal FLM has the logic low level during five horizontal times. However, the start signal FLM is not limited thereto. For example, the start signal FLM has the logic low level within a range of 3 through 10 horizontal times. Here, the nth gate signal SCAN[n] may have pulses (or logic low levels) of which number is in a range of 2 through 5.

Figure 6:
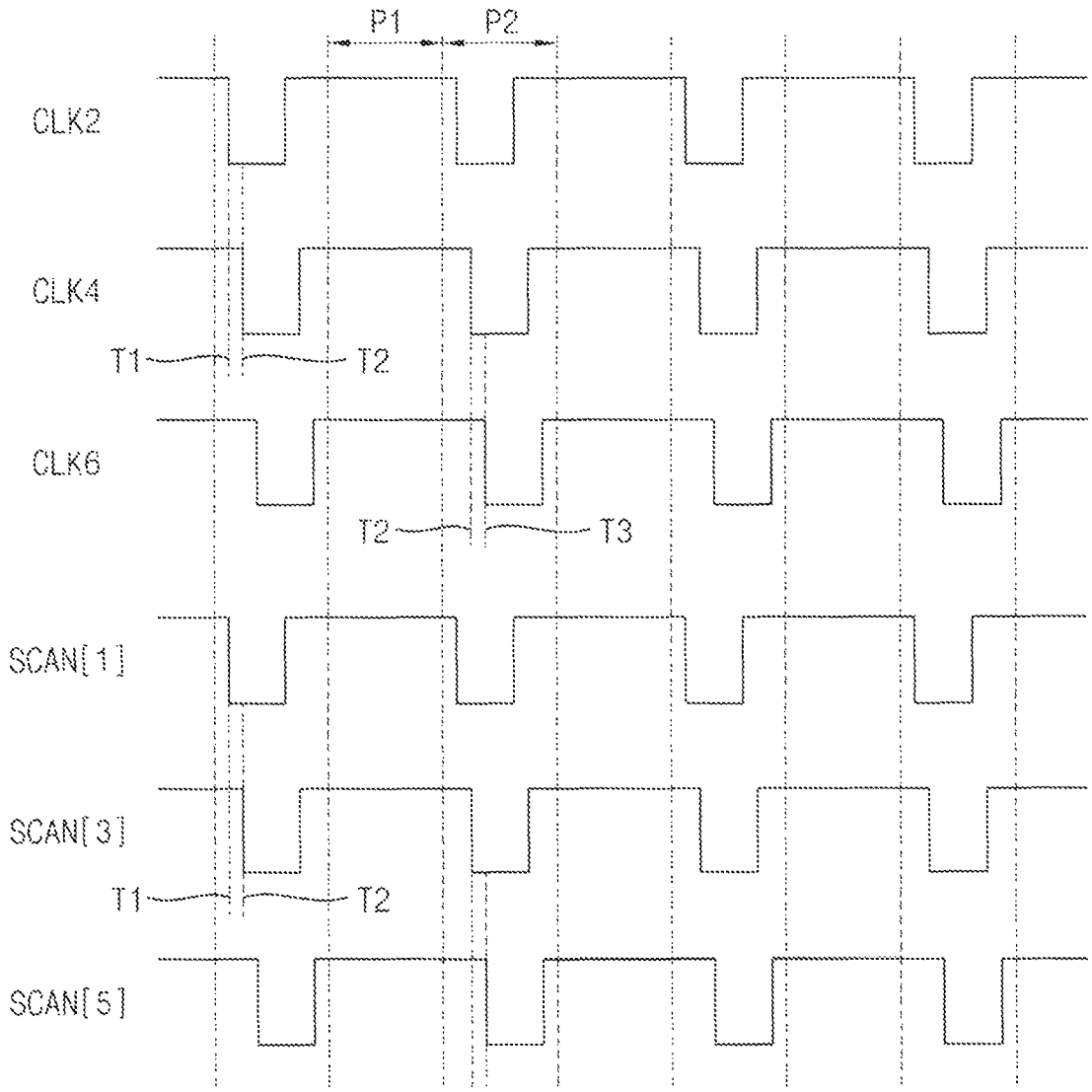
FIG. 6 is a waveform diagram illustrating an example of clock signals provided to the gate driver of FIG. 2.

FIG. 6 is a waveform diagram illustrating an example of clock signals provided to the gate driver of FIG. 2.

Referring to FIG. 6, the second clock signal CLK2 may have the logic high level in a period P1 and may have the logic low level in a second period P2. Compared with the second clock signal CLK2 illustrated in FIG. 3, the second clock signal CLK2 illustrated in FIG. 6 may have a shorter period of the logic low level during the second period P2. Similarly, the fourth clock signal CLK4 may have the logic high level in a period P1 and may have the logic low level in a second period P2, and the sixth clock signal CLK6 may have the logic high level in a period P1 and may have the logic low level in a second period P2.

That is, the second clock signal CLK2, the fourth clock signal CLK4, and the sixth clock signal CLK6 may have the same period and the same waveform. But the second clock signal CLK2, the fourth clock signal CLK4, and the sixth clock signal CLK6 may have different phase. For example, the fourth clock signal CLK4 may have a phase which is delayed with respect to the second clock signal CLK2, and the sixth clock signal CLK6 may have a phase which is delayed with respect to the fourth clock signal CLK4.

Here, the first gate signal SCAN[1] may have a waveform equal to a waveform of the second clock signal CLK2, the third gate signal SCAN[3] may have a waveform equal to a waveform of the forth clock signal CLK4, and the fifth gate signal SCAN[5] may have a waveform equal to a waveform of the sixth clock signal CLK6. That is, the first gate signal SCAN[1] may be shifted to have the logic low level at a first time point T1, the third gate signal SCAN[3] may be shifted to have the logic low level at a second time point T2 later than the first time point T1, and the fifth gate signal SCAN[5] may be shifted to have the logic low level at a third time point T3 later than the second time point T2.

When the display device 100 use the clock signals CLK1 through CLK6 illustrated in FIG. 3, power consumption is concentrated at a start point of the first period P1 (or at a start point of the second period P2). When the display device 100 use the clock signals CLK1 through CLK6 illustrated in FIG. 6, power consumption is distributed at several points (e.g., at the first through third time point P1 through P3) because the clock signals CLK2, CLK4, and CLK6 have a phase difference to each other. Therefore, the display device 100 may prevent a voltage drop due to a concentration of power consumption and degradation of display quality.

Figure 7:
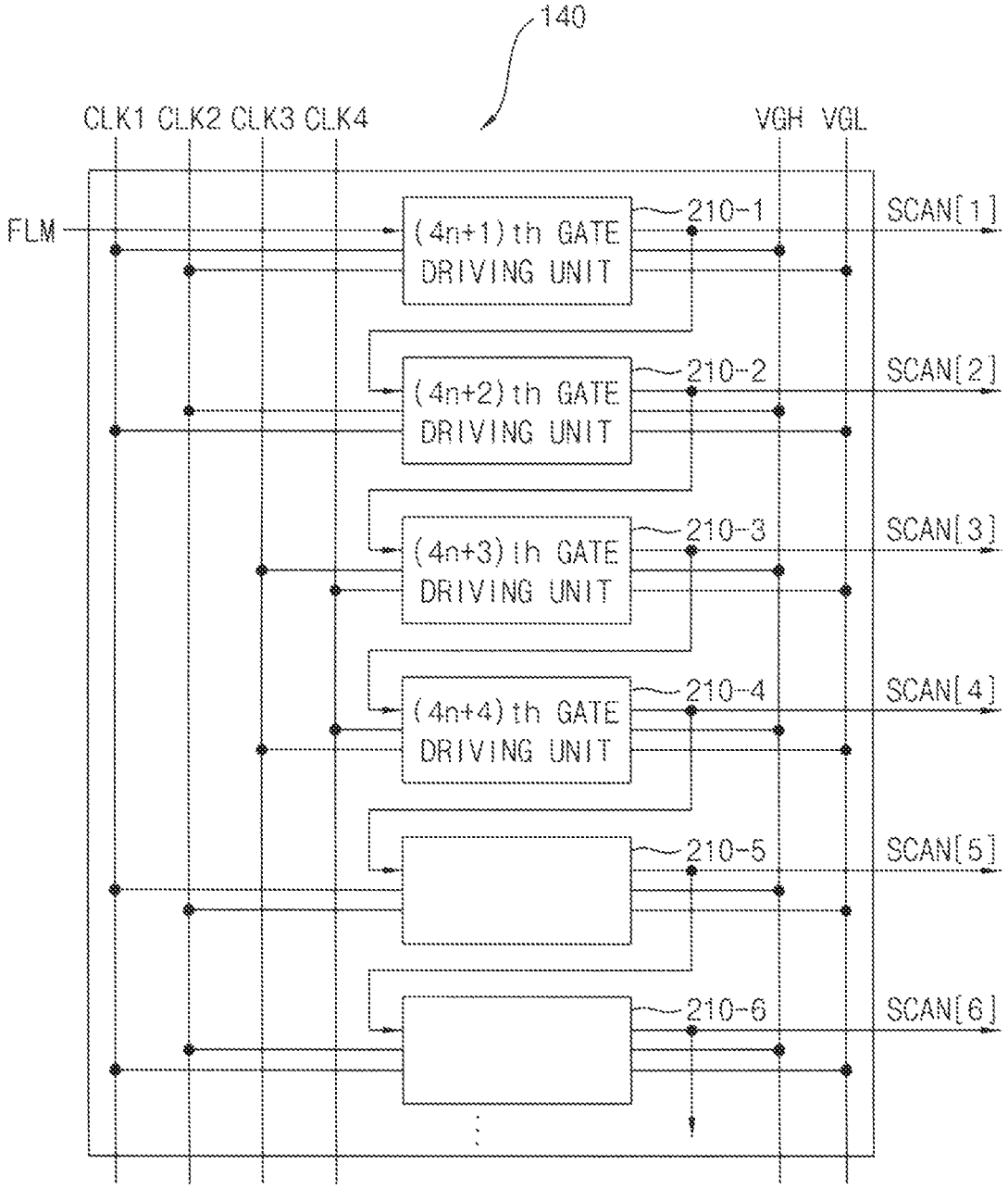
FIG. 7 is a diagram illustrating an example of a gate driver included in the display device of FIG. 1.

FIG. 7 is a diagram illustrating an example of a gate driver included in the display device of FIG. 1.

Referring to FIGS. 2 and 7, the gate driver 140 of FIG. 7 may be the same as or substantially the same as the gate driver 140 of FIG. 2. Therefore, duplicated description will not be repeated.

The gate driver 140 of FIG. 7 may include four clock signal lines transferring first through fourth clock signals CLK1 through CLK4. Here, the first through fourth clock signals CLK1 through CLK4 may be the same as or substantially the same as the first through fourth clock signals CLK1 through CLK4 described with reference to FIGS. 2 and 3.

The first gate driving unit 210-1 (or a (4n+1)th gate driving unit) may be the same as the first gate driving unit 210-1 illustrated in FIG. 2, the second gate driving unit 210-2 (or a (4n+2)th gate driving unit) may be the same as the second gate driving unit 210-2 illustrated in FIG. 2, the third gate driving unit 210-3 (or a (4n+3)th gate driving unit) may be the same as the third gate driving unit 210-3 illustrated in FIG. 2, and the fourth gate driving unit 210-4 (or a (4n+4)th gate driving unit) may be the same as the fourth gate driving unit 210-4 illustrated in FIG. 2.

The fifth gate driving unit 210-5 may be electrically connected to the first clock signal line (e.g., a clock signal line transferring the first clock signal CLK1) and the second clock signal line (e.g., a clock signal line transferring the second clock signal CLK2), may receive the high voltage VGH, the low voltage VGL, and the fourth gate signal SCAN[4], and may output a fifth gate signal SCAN[5] based on the first clock signal CLK1, the second clock signal CLK2, and the fourth gate signal SCAN[4]. That is, a configuration of connection and operation of the fifth gate driving unit 210-5 may be the same as or substantially the same as a configuration of connection and operation of the first gate driving unit 210-1.

Similarly, the sixth gate driving unit 210-6 may be substantially the same as the second gate driving unit 210-1, may receive the fifth gate signal SCAN[5], and may output a sixth gate signal SCAN[6] based on the first clock signal CLK1, the second clock signal CLK2, and the fifth gate signal SCAN[5].

Here, the first clock signal CLK1 may be used to generate the second gate signal SCAN[2] and the sixth gate signal SCAN[6]. Therefore, a load of the first clock signal CLK1 may be reduced as two-third of a load of a clock signal which is used to generate three gate signals (e.g., the second gate signal SCAN[2], the fourth gate signal SCAN[4], and the sixth gate signal SCAN[6]). Similarly, the second signal CLK2 may be used to generate the first gate signal SCAN[1] and the fifth gate signal SCAN[5] such that a load of the second clock signal CLK2 may be two-third of a load of a clock signal which is used to generate three gate signals.

Though loads of the first through fourth clock signals CLK1 through CLK4 increase with respect to loads of the first through fourth clock signals CLK1 through CLK4 described with reference to FIG. 2, an area in which clock signal lines are located may be decreased as compared to an area for clock signal lines as illustrated in FIG. 2.

When the gate signals have two pulses instead of three pulses (or a logic low level), the loads of the first through fourth clock signals CLK1 through CLK4 may be equal to the loads of the first through fourth clock signals CLK1 through CLK4 described with reference to FIG. 2.

That is, a number of the clock signals (or a number of clock signal lines) may be determined based on a number of pulses included in the gate signals and an area for the clock signal lines (e.g., a dead space of the display panel 110).

It is illustrated in FIG. 7 that the gate driver 140 uses the first through fourth clock signals CLK1 through CLK4. However, the gate driver 140 is not limited thereto. For example, the gate driver 140 may use clock signals of which a number is within a range of 3 through 10 and may include clock signal lines respectively transferring the clock signals.

The present inventive concept may be applied to any display device (e.g., an organic light emitting display device, a liquid crystal display device, etc) including a gate driver. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A gate driver comprising:

clock signal lines respectively transferring clock signals, at least two of the clock signals having the same phase and pulse width and being independent from each other; and gate driving units electrically connected to the clock signal lines, respectively, and configured to sequentially generate gate signals having a multi-clock pulse based on the clock signals, wherein the clock signal lines transfer clock signals to respective gate driving units, wherein the at least two of the clock signals having the same phase and pulse width and being independent from each other are applied to different gate driving units and are not applied to a same gate driving unit, wherein a (6*n*+1)th gate driving unit among the gate driving units generates a (6*n*+1)th gate signal based on a first clock signal having a logic low level in a first period and a logic high level in a second period, where n is a positive integer, wherein a (6*n*+2)th gate driving unit adjacent to the (6*n*+1)th gate driving unit generates a (6*n*+2)th gate signal based on a second clock signal having a logic high level in the first period and a logic low level in the second period, and wherein a (6*n*+3)th gate driving unit adjacent to the (6*n*+2)th gate driving unit generates a (6*n*+3)th gate signal based on a third clock signal having a logic low level in the first period and a logic high level in the second period, the third clock signal and the first clock signal being provided to the respective gate driving units through different clock signal lines.

2. The gate driver of claim 1, wherein at least two of the gate driving units adjacent to each other receive the same clock signal which has the same period, the same wave form and the same phase.

3. The gate driver of claim 1, wherein the multi-clock pulse includes unit pulses for a driving period of the gate driver.

4. The gate driver of claim 1, wherein the first period is a first half period of the first clock signal, and the second period is a second half period of the first clock signal.

5. The gate driver of claim 1, wherein a (6*n*+4)th gate driving unit adjacent to the (6*n*+3)th gate driving unit generates a (6*n*+4)th gate signal based on a fourth clock signal having a logic high level in the first period and a logic low level in the second period, the fourth clock signal and the second clock signal being provided to respective gate driving units through different clock signal lines, wherein a (6*n*+5)th gate driving unit adjacent to the (6*n*+4)th gate driving unit generates a (6*n*+5)th gate signal based on a fifth clock signal having a logic low level in the first period and a logic high level in the second period, the fifth clock signal and the-first clock signal being provided to respective gate driving units through different clock signal lines, and wherein a (6*n*+6)th gate driving unit adjacent to the (6*n*+5)th gate driving unit generates a (6*n*+6)th gate signal based on a sixth clock signal having a logic high level in the first period and a logic low level in the second period, the sixth clock signal and the second clock signal being provided to respective gate driving units through different clock signal lines.

6. The gate driver of claim 5, wherein the (6*n*+1)th gate driving unit outputs the first clock signal having a logic low level as the (6*n*+1)th gate signal based on a start signal having a logic low level and the second clock signal having a logic low level, and wherein the (6*n*+2)th gate driving unit outputs the second clock signal having a logic low level as the (6*n*+2)th gate signal based on the (6*n*+1)th gate signal having a logic low level and the first clock signal having a logic low level.

7. The gate driver of claim 6, wherein the (6*n*+3)th gate driving unit outputs the third clock signal having a logic low level as the (6*n*+3)th gate signal based on the (6*n*+2)th gate signal having a logic low level and the fourth clock signal having a logic low level, and wherein the (6*n*+4)th gate driving unit outputs the fourth clock signal having a logic low level as the (6*n*+4)th gate signal based on the (6*n*+3)th gate signal having a logic low level and the third clock signal having a logic low level.

8. The gate driver of claim 6, wherein the (6*n*+5)th gate driving unit outputs the fifth clock signal having a logic low level as the (6*n*+5)th gate signal based on the (6*n*+4)th gate signal having a logic low level and the sixth clock signal having a logic low level, and wherein the (6*n*+6)th gate driving unit outputs the sixth clock signal having a logic low level as the (6*n*+6)th gate signal based on the (6*n*+5)th gate signal having a logic low level and the fifth clock signal having a logic low level.

9. The gate driver of claim 1, wherein the third clock signal has a period, a waveform and a phase which are the same as a period, a waveform and a phase of the first clock signal.

10. The gate driver of claim 1, wherein the clock signal lines include a first clock signal line transferring the first clock signal, a second clock signal line transferring the second clock signal, and a third clock signal line transferring the third clock signal.

11. A display device comprising:

a display panel;

clock signal generator configured to generate clock signals, at least two of the clock signals having the same phase and pulse width and being independent from each other; and a gate driver configured to sequentially provide the display panel with gate signals having a multi-clock pulse, wherein the gate driver includes:

clock signal lines respectively transferring the clock signals, and gate driving units electrically connected to the clock signal lines, respectively and configured to sequentially generate the gate signals based on the clock signals, wherein the clock signal lines transfer clock signals to respective gate driving units, wherein the at least two of the clock signals having the same phase and pulse width and being independent from each other are applied to different gate driving units and are not applied to a same gate driving unit, wherein a (6*n*+1)th gate driving unit among the gate driving units generates a (6*n*+1)th gate signal based on a first clock signal having a logic low level in a first period and a logic high level in a second period, where n is a positive integer, wherein a (6*n*+2)th gate driving unit adjacent to the (6*n*+1)th gate driving unit generates a (6*n*+2)th gate signal based on a second clock signal having a logic high level in the first period and a logic low level in the second period, and wherein a (6*n*+3)th gate driving unit adjacent to the (6*n*+2)th gate driving unit generates a (6*n*+3)th gate signal based on a third clock signal having a logic low level in the first period and a logic high level in the second period, the third clock signal and the first clock signal being provided to the respective gate driving units through different clock signal lines.

12. The display device of claim 11, wherein at least two of the gate driving units adjacent to each other receive the same clock signal.

* * * * *